United States Patent [19]

Allam et al.

[11] Patent Number: 4,943,485

[45] Date of Patent: Jul. 24, 1990

[54] PROCESS FOR APPLYING HARD COATINGS AND THE LIKE TO METALS AND RESULTING PRODUCT

[75] Inventors: Ibrahim M. Allam, Dhahran, Saudi Arabia; David J. Rowcliffe, Stockholm, Sweden

[73] Assignee: S R I International, Menlo Park, Calif.

[21] Appl. No.: 381,508

[22] Filed: Jul. 18, 1989

Related U.S. Application Data

[60] Division of Ser. No. 111,202, Oct. 21, 1987, Pat. No. 4,857,116, which is a continuation-in-part of Ser. No. 325,504, Nov. 27, 1981, Pat. No. 4,483,720, and a continuation-in-part of Ser. No. 662,253, Oct. 17, 1984, abandoned, and a continuation-in-part of Ser. No. 662,252, Oct. 17, 1984, abandoned.

[51] Int. Cl.[5] ..... B32B 15/04

[52] U.S. Cl. ..... 428/457; 428/698; 428/704

[58] Field of Search ..... 428/457, 704, 698; 427/34; 148/426, 105, 6.3

[56] References Cited

U.S. PATENT DOCUMENTS 3,622,234 11/1971 Seybolt ..... 148/426 X
4,229,234 10/1980 Krutenat et al. ..... 148/105
4,342,792 8/1982 Brown et al. ..... 427/34

FOREIGN PATENT DOCUMENTS 1086708 10/1967 United Kingdom .
1396898 6/1975 United Kingdom .
1439947 6/1976 United Kingdom .

*Primary Examiner*—Thomas J. Herbert
*Attorney, Agent, or Firm*—Edward B. Gregg; Urban H. Faubion; John Y. Chen

[57] ABSTRACT

Protective coatings are applied to substrate metals by coating the metal surface, e.g. by dipping the substrate metal in a molten alloy of the coating metals, and then exposing the coating at an elevated temperature to an atmosphere containing a reactive gaseous species which forms a nitride, a carbide, a boride or a silicide. The coating material is a mixture of the metals $M_1$ and $M_2$, $M_1$ being zirconium and/or titanium, which forms a stable nitride, carbide, boride or silicide under the prevailing conditions. The metal $M_2$ does not form a stale nitride, carbide, boride or silicide. $M_2$ serves to bond the carbide, etc. of $M_1$ to the substrate metal. Mixtures of $M_1$ and/or $M_2$ metals may be employed. This method is much easier to carry out than prior methods and forms superior coatings. Eutectic alloys of $M_1$ and $M_2$ which melt substantially lower than the melting point of the substrate metal are preferred.

16 Claims, 1 Drawing Sheet

PROCESS FOR APPLYING HARD COATINGS AND THE LIKE TO METALS AND RESULTING PRODUCT

This is a divisional of application Ser. No. 07/111,202, filed on Oct. 21, 1987, now U.S. Pat. No. 4,857,116 issued Aug. 5, 1989, which is a continuation-in-part of copending applications as follows: Ser. No. 325,504, filed Nov. 27, 1981, entitled "PROCESS FOR APPLYING THERMAL BARRIER COATINGS TO METALS AND RESULTING PRODUCT", now U.S. Pat. No. 4,483,720; Ser. No. 662,253, filed Oct. 17, 1984, entitled "PROCESS FOR APPLYING COATINGS TO METALS AND RESULTING PRODUCT", now abandoned; and Ser. No. 662,252, filed Oct. 17, 1984, entitled "PROCESS FOR APPLYING HARD COATINGS AND THE LIKE TO METALS AND RESULTING PRODUCT", now abandoned.

This invention relates to the coating of metals (hereinafter referred to as "substrates" or "substrate metals") with coatings that serve to provide hard surfaces, chemically resistant coatings, etc.

Hard coatings were developed for the purpose of providing a combination of high performance properties such as resistance to friction, wear and corrosion to less expensive metal components. Early techniques used in the application of these coatings were based on surface treatment of metallic substrates by the diffusion of carbon, nitrogen, boron, or silicon, thus generating the hard materials directly in the surface of the substrate. Most of the more recent application techniques involve the deposition of an overlay hard layer as an external coating. Examples of techniques include: Chemical vapor deposition (CVD), physical vapor deposition (PVD), laser fusion, sputtering, flame or plasma spraying, and detonation gun. With the possible exception of CVD processes, these techniques are expensive and limited to the line of sight which may lead to variable thickness and unequal coverage particularly at corners, holes and complex shapes.

Other methods of applying protective coatings to metal substrates include those described in the following British patents:

British Patent No. 1,086,708 describes substrate metals consisting of tungsten, molybdenum or alloys of the two metals; and forming an oxide layer on the surface of the substrate metal, e.g. by selective oxidation of the chromium content of the surface. Alternatively, as in Example 7, a metal such as palladium maybe applied by electroplating, then chromium also by electroplating, and the chromium is then oxidized by exposure to moist hydrogen. The preferentially oxidizable metal, i.e. the metal which forms an oxide, is used in an amount not exceeding 15% of the alloy used as the protective coating. Metals which are described as preferentially oxidizable are Th, Ti, Hf, Zr, U, Mg, Ce, Al and Be. I.e. they are metals which, when alloyed with a less oxidizable metal, can be selectively oxidized without, presumably, oxidizing the alloying metal.

British Patent No. 1,396,898 dips a ferrous metal substrate into a molten alloy of aluminum and chromium and then oxidizes the aluminum to aluminum oxide.

British Patent No. 1,439,947 applies to a ferrous or non-ferrous metal substrate a coating by plasma deposition. The coating so applied is an alloy of two metals one of which forms an oxide, a nitride, a carbide, a boride or a silicide more readily than the other metal; then the coating is subjected to an atmosphere which, it is asserted, forms the desired oxide, carbide, etc. with the one metal without forming it with the other metal. Metals mentioned at page 4, commencing at line 8 are Ni, Al, Co, Fe, Cr, Cu, Mo, W, Nb, Si, Ta, Ti, Zn, Mn, Zr, V and Hf and their alloys.

It is an object of the present invention to provide an improved method of applying to substrate metals coatings of carbide, nitride, boride or silicide.

It is a further object of the invention to provide coated substrate metals in which the coatings, as described above, are uniform and adherent to the substrate.

The above and other objects of the invention will be apparent from the ensuing description and the appended claims.

In accordance with the present invention a coating alloy or a coating mixture of two or more metals is provided. At least one of these metals is zirconium, titanium or a mixture or alloy of zirconium and titanium. The aforesaid coating alloy or coating mixture also contains a metal $M_2$ having the properties described below.

Zirconium and titanium form stable carbides, nitrides, borides and silicides. For example they form stable carbides at high temperatures in an atmosphere of methane. By contrast the metal $M_2$ in the coating alloy or mixture does not form a stable carbide, nitride, boride or silicide under such conditions.

Hereinafter the metals Zr and Ti are sometimes referred to collectively as $M_1$ and the elements N, C, B and Si are sometimes referred to collectively as X.

This coating alloy or coating mixture is then melted to provide a uniform melt which is then applied to a metal substrate, e.g. by dipping the substrate into the melt. Alternatively, the coating mixture or coating alloy is reduced to a finely divided state, and the finely divided metal is incorporated in a volatile solvent to form a slurry which is applied to the metal substrate by spraying or brushing. The resulting coating is heated in an inert atmosphere to accomplish evaporation of the volatile solvent and the fusing of the alloy or metal mixture onto the surface of the substrate. (Where physical mixtures of metals are used, they are converted to an alloy by melting or they are alloyed or fused together in situ as in the slurry method of application described above.) In certain instances, as where the alloy melts at a high temperature such that the substrate metal might be adversely affected by melting the coating of alloy, the alloy may be applied by plasma spraying. Preferably, however, eutectic coating alloys are employed which melt below the melting point of the substrate metal.

It will be understood that $M_2$ may be a mixture or alloy of two or more metals meeting the requirements of $M_2$.

The coating thus formed and applied is then preferably subjected to an annealing step. The annealing step may be omitted when annealing occurs under conditions of use.

When a coating of suitable thickness has been applied to the substrate metal by the dip coating process or by the slurry process described above (and in the latter case after the solvent has been evaporated and the $M_1/M_2$ metal alloy or mixture is fused onto the surface of the substrate) or by any other suitable process the surface is then exposed to an appropriate reactive atmosphere at an appropriate elevated temperature. Such an atmosphere is provided by a thermally dissociable compound or molecule of nitrogen, carbon, boron or silicon. Examples of suitable gaseous media are set forth in Table I below.

TABLE I

| X | Gaseous Media for Forming Nitrides, Carbides, Borides and silicides<br>Gaseous Media |
|---|---|
| N | $N_2$, $NH_3$ or mixtures of the two. |
| C | Methane, acetylene. |
| B | Borane, diborane, borohalides. |
| Si | Silane, trichloro silane, tribromosilane, silicon tetrachloride. |

The partial pressure of the reactive species is such that $M_1$ forms a stable compound of nitrogen, carbon, boron or silicon and $M_2$ does not form such a stable compound. If a very low partial pressure of the reactive species is required, that species may be diluted by an inert gas, e.g. argon.

The temperature chosen should, of course, be sufficient to form the desired compound of $M_1$, but above the temperature of decomposition of the corresponding compound (if one is formed at all) of $M_2$. The temperature should be at or below the melting points of the coating alloy but the temperature is also preferably sufficiently high to produce the desired coating within a treatment time of eight hours.

Reverting to the choice of what may be called the binding metal $M_2$ (so-called because it remains in metallic form and serves to bond the zirconium and/or titanium carbide, etc. to the substrate metal), although many metals may be used it is preferred to use copper, nickel, cobalt or iron.

Thus eutectic alloys of iron, nickel and/or cobalt readily wet and adhere to iron, nickel and cobalt based alloys used as substrates. Eutectic alloys of copper readily wet and adhere to substrates of copper and other non-ferrous alloys. Also iron, nickel, cobalt and copper are readily obtainable and are inexpensive. Further the eutectic melting points of alloys of these metals generally lie below the temperature of degradation of many substrates. Also the free energy of formation of the nitrides and carbides of titanium and zirconium is far more negative than the free energy of formation of the nitrides and carbides of the aforesaid $M_2$ metals, thus more thermodynamically stable.

Also it is preferred that the zirconium and/or titanium be present in the coating alloy or mixture in very substantial amounts, e.g. 50% or more and preferably 70% or more, by weight.

Figure 1:
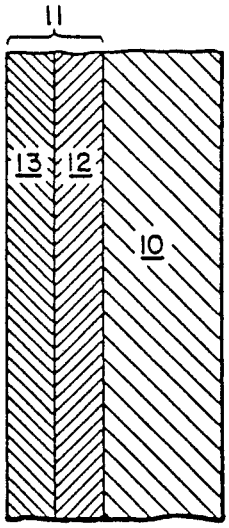
FIGS. 1 and 1A illustrate two structures of the coated substrate of the invention.

There results from this process a structure such as shown in FIG. 1 of the drawings.

Referring now to FIG. 1, this figure represents a cross-section through a substrate alloy indicated at 10 coated with a laminar coating indicated at 11. The laminar coating 11 consists of an intermediate metallic layer 12 and an outer $M_1X_n$ layer 13 ($M_1$ being Zr and cr Ti.) The relative thicknesses of the layers 12 and 13 are exaggerated. The substrate layer 10 is as thick as required for the intended service.

The layers 12 and 13 together typically will be about 1 to 10 microns thick. It will be understood that the layer 12 will have a thickness adequate to form a firm bond with the substrate and that the layer 13 will have a thickness suiting it to its intended use. If, for example, an layer is provided which will act as a thermal barrier, a thicker layer may be desired than in the case where the purpose is to provide a hard surface.

Figure 1A:
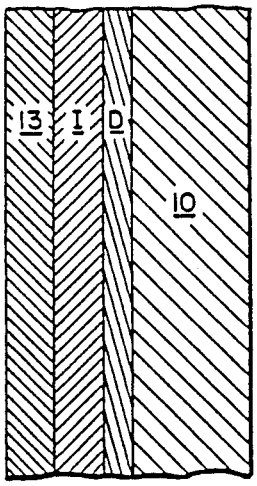

FIG. 1 is a simplified representation of the coating and substrate. A more accurate representation is shown in FIG. 1A in which the substrate 10 and outer layer $M_1X_n$ are as described in FIG. 1. However there is a diffusion zone D which may be an alloy of one or more substrate metals and the metal $M_2$ inwardly into the substrate. There is also an intermediate zone I which may be a cermet formed as a composite of $M_1X_n$ and $M_2$.

Table II below lists metals that may be used as $M_2$.

TABLE II

| ($M_2$) | |
|---|---|
| Cobalt | Nickel |
| Copper | Palladium |
| Iron | Platinum |
| Molybenum | Rhodium |

As stated above eutectic alloys which melt below the melting point, preferably substantially below the melting point of the substrate metal are preferred.

Examples of eutectic alloys are listed in Table III. It will be understood that not all of these alloys are useful on all substrates. In some cases the melting points are approximate. Numbers indicate the approximate percentage by weight of $M_2$.

TABLE III

| Eutectic Alloy | Melting Point (°C.) |
|---|---|
| Ti - 28.5 Ni | 942 |
| Ti - 32 Fe | 1085 |
| Ti - 28 Co | 1025 |
| Ti - 50 Cu | 955 |
| Ti - 72 Cu | 885 |
| Ti - 48 Pd | 1080 |
| Zr - 17 Ni | 960 |
| Zr - 27 Ni | 1010 |
| Zr - 16 Fe | 934 |
| Zr - 27 Co | 1061 |
| Zr - 54 Cu | 885 |
| Zr - 27 Pd | 1030 |
| Zr - 37 Pt | 1185 |
| Zr - 25 Rh | 1065 |

Alloys of three or more of these metals may be used if they have suitable melting points, e.g. do not have melting points which are so high as to be destructive of the substrate metal.

Table IV provides examples of metal substrates to the metal pairs may be applied.

Table IV

Superalloys
- Cast nickel base such as IN 738
- Cast cobalt base such as MAR-M509
- Wrought nickel base such as Rene 95
- Wrought cobalt base such as Haynes alloy No. 188
- Wrought iron base such as Discaloy
- Hastalloy X
- RSR 185
- Incoloy 901

Coated Superalloys (coated for corrosion resistance)

Superalloys coated with Co(or Ni)-Cr-Al-Y alloy, e.g. 15–25% Cr, 10–15% Al, 0.5% Y, balance is Co or Ni Steels
- Tool Steels (wrought, cast or powder metallurgy) such as AISIM2; AISIW1

Stainless Steels
- Austenitic 304
- Ferritic 430
- Martensitic 410

Carbon Steels
- AISI 1018

Alloy Steels
- AISI 4140
- Maragin 250

Cast Irons
- Gray, ductile, malleable, alloy UNSF 10009

Non-ferrous Metals
- Titanium and titanium alloys, e.g. ASTM Grade 1; Ti-6Al-4V
- Nickel and nickel alloys, e.g. nickel 200, Monel 400 Cobalt
- Copper and its alloys, e.g. C 10100; C 17200; C 26000; C95200

Refractory Metals and Alloys
- Molybdenum alloys, e.g. TZM
- Niobium alloys, e.g. FS-85
- Tantalum alloys, e.g. T-111
- Tungsten alloys, e.g. W-Mo alloys Cemented Carbides
- Ni and cobalt bonded carbides, e.g. WC-3 to 25 Co
- Steel bonded carbides, e.g. 40–55 vol. % TiC, balance steel; 10–20% TiC-balance steel The dip coating method is preferred. It is easy to carry out and the molten alloy removes surface oxides (which tend to cause spallation). In this method a molten $M_1/M_2$ alloy is provided and the substrate alloy is dipped into a body of the coating alloy. The temperature of the alloy and the time during which the substrate is held in the molten alloy will control the thickness and smoothness of the coating. If an aerodynamic surface or a cutting edge is being prepared a smoother surface will be desired than for some other purposes. The thickness of the applied coating can range between a fraction of one micron to a few millimeters. Preferably, a coating of about 300 microns to 400 microns is applied if the purpose is to provide a thermal barrier. A hardened surface need not be as thick. It will be understood that the thickness of the coating will be provided in accordance with the requirements of a particular end use.

The slurry fusion method has the advantage that it dilutes the coating alloy or metal mixture and therefore makes it possible to effect better control over the thickness of coating applied to the substrate. Also complex shapes can be coated and the process can be repeated to build up a coating of desired thickness. Typically, the slurry coating technique may be applied as follows: A powdered alloy of $M_1$ (zirconium, titanium or an alloy of the two metals) and $M_2$ is mixed with a mineral spirit and an organic cement such as Nicrobraz 500 (Well Colmonoy Corp.) and MPA-60 (Baker Caster Oil Co.). Typically proportions used in the slurry are coating alloy 45 weight percent, mineral spirit 10 weight percent, and organic cement, 45 weight percent. This mixture is then ground, for example, in a ceramic ball mill using aluminum oxide balls. After separation of the resulting slurry from the alumina balls, it is applied (keeping it stirred to insure uniform dispersion of the particles of alloy in the liquid medium) to the substrate surface and the solvent is evaporated, for example, in air at ambient temperature or at a somewhat elevated temperature. The residue of alloy and cement is then fused onto the surface by heating it to a suitable temperature in an inert atmosphere such as argon that has been passed over hot calcium chips to getter oxygen. The cement will be decomposed and the products of decomposition are volatilized.

If the alloy of $M_1$ and $M_2$ has a melting point which is sufficiently high that it exceeds or closely approaches the melting point of the substrate, it may be applied by sputtering, by vapor deposition or some other technique.

It is advantageous to employ $M_1$ and $M_2$ in the form of an alloy which is a eutectic or near eutectic mixture. This has the advantage that a coating of definite, predictable composition is uniformly applied. Also eutectic and near eutectic mixtures have lower melting points than non-eutectic mixtures. Therefore they are less likely than high melting alloys to harm the substrate metal and they sinter more readily than high melting alloys.

The following specific examples will serve further to illustrate the practice and advantages of the invention.

EXAMPLE 1

The substrate metal was tool steel in the form of a rod. The coating alloy was a eutectic alloy containing 71.5% Ti and 28.5% Ni. This eutectic has a melting point of 942° C. The rod was dipped into this alloy at 1000° C. for 10 seconds and was removed and annealed for 5 hours at 800° C. It was then exposed to oxygen free nitrogen for 15 hours at 800° C. The nitrogen was passed slowly over the rod at atmospheric pressure. The resulting coating was continuous and adherent. The composition of the titanium nitride, $TiN_x$, depends upon the temperature and the nitrogen pressure.

EXAMPLE 2

Example 1 was repeated using mild steel as the substrate. A titanium nitride layer was applied.

The coatings of Examples 1 and 2 are useful because the treated surface is hard. This is especially helpful with mild steel which is inexpensive but soft. This provides a way of providing an inexpensive metal with a hard surface.

EXAMPLE 3

The same procedure was carried out as in Example 1 but at 650° C. The coating, 2 microns thick, was lighter in color than the coating of Example 1.

Darker colors obtained at higher temperatures indicated a stoichiometric composition, TiN.

Similar coatings were applied to stainless steel.

EXAMPLE 4

A eutectic alloy of 83% Zr and 17% Ni (melting point=961° C.) is employed. The substrate metal (tool steel) is dip coated at 1000° C., annealed 3 hours at 1000° C. and exposed to nitrogen as in Examples 1 and 3 at 800° C. A uniform adherent titanium nitride coating 2 to 3 microns thick resulted.

EXAMPLE 5

A 48% Zr–52% Cu eutectic alloy, melting point 885° C. was used. Tool steel was dipped into the alloy for 10 seconds at 1000° C. and was withdrawn and annealed 5 hours at 1000° C. It was then exposed to nitrogen at one atmosphere for 50 hours at 800° C. A uniform adherent zirconium nitride coating resulted.

An advantage of copper as the metal $M_2$ is that it is a good heat conductor which is helpful in carrying away heat (into the body of the tool) in cutting.

EXAMPLE 6

A 77% Ti–23% Cu alloy, a eutectic alloy, melting at 875° C. was used. Hot dipping was at 1027° C. for 10 seconds; annealing at 900° C. for 5 hours; exposure to $N_2$ at 900° C. for 100 hours. An adherent continuous titanium nitride coating resulted. The substrate metal was high speed steel.

EXAMPLE 7

Tool steel was coated with a Ti-Ni alloy and annealed as in Example 1. The reactive gas species is methane which may be used with or without an inert gas diluent such as argon or helium. The coated steel rod is exposed to methane at 1000° C. for 20 hours. A hard, adherent coating of titanium carbide results.

EXAMPLE 8

The procedure of Example 7 may be repeated using $BH_3$ as the reactive gas species at a temperature above 700° C., e.g. 700° C. to 1000° C., for ten to twenty hours. A titanium boride coating is formed which is hard and adherent.

EXAMPLE 9

The procedure of Example 7 is repeated using silane, $Si\ H_4$, as the reactive gas species, with or without a diluting inert gas such as argon or helium. The temperature and time of exposure may be 700° C. to 1000° C. for ten to twenty hours. A titanium silicide coating is formed which is hard and adherent.

Among other considerations are the following:

The metal $M_2$ should be compatible with the substrate. For example, it should not form brittle intermetallic compound with metals of the substrate. Preferably it does not alter seriously the mechanical properties of the substrate and has a large range of solid solubility in the substrate. Also it preferably forms a low melting eutectic with $M_1$. Also it should not form a highly stable carbide, nitride, boride or silicide. For example, if $M_1$ is to be converted to a carbide or a nitride, $M_2$ should not form a stable carbide or nitride under the conditions employed to form the $M_1$ carbide or nitride.

In the hot dipping method of application of an $M_1/M_2$ alloy, uneven surface application may be avoided or diminished by spinning and/or wiping.

The annealing step after application of the alloy or mixture of $M_1$ and $M_2$ should be carried out to secure a good bond between the alloy and the substrate.

Conversion of the alloy coating to the final product is preferably carried out by exposure to a slowly flowing stream of the reactive gas at a temperature and pressure sufficient to react the reactive gaseous molecule or compound with $M_1$ but not such as to react with $M_2$. It is also advantageous to employ a temperature slightly above the melting point of the coating alloy, e.g. slightly above its eutectic melting point. The presence of a liquid phase promotes migration of $M_1$ to the surface and displacement of $M_2$ in the outer layer.

If the temperature is below the melting point of the coating alloy and if the compound formed by $M_1$ and the reactive gaseous species grows fast, $M_2$ will be entrapped in the growing compound, thus bonding the particles of $M_1X_n$. In this case a cermet will be formed which may be advantageous, e.g. a W or Nb carbide cemented by cobalt or nickel.

It will therefore be apparent that a new and useful method of applying $M_lX_n$ coating to a metal substrate, and new and useful products are provided.

We claim:

1. A coated metal substrate comprising:

(a) a metal substrate and (b) a coating on and adherent to at least one surface of the substrate, such coating being an alloy of $M_1$ and $M_2$ wherein $M_1$ is zirconium or titanium and $M_2$ is a more noble metal than $M_1$ and which forms a less thermodynamically stable compound than $M_1$ with the elements N, C, B and Si or forms no such compound, the metal $M_1$ being present in an amount not less than 50% by weight, $M_2$ being present in substantial amount not exceeding 50% by weight and sufficient to act as a binder for the nitride, carbide, boride or silicide of $M_1$ to the substrate such coating being of a uniform, non-porous character such that, upon selective reaction of the coating with a reactive molecular species of such element to form such a compound of zirconium or titanium with N, C, B or Si, the resulting coating is uniform, dense and substantially free of porosity.

2. The coating metal article of claim 1 wherein the metal substrate is a non-ferrous alloy.

3. The coated metal article of claim 1 wherein the metal substrate is stainless steel.

4. The coated metal article of claim 1 wherein the metal substrate is a superalloy.

5. The coated metal article of claim 1 wherein $M_1$ is zirconium.

6. The coated metal article of claim 1 wherein $M_1$ is titanium.

7. The coated metal article of any one of claims 1 to 6 in which the metal $M_2$ is nickel or cobalt and its alloy with the metal $M_1$ is a eutectic alloy.

8. A coated metal article comprising:

(a) a metal substrate and (b) a protective coating on and adherent to at least one surface of the metal substrate, said coating being dense, adherent and substantially non-porous, such coating comprising an outer layer of a compound $M_1/X_n$ wherein X is nitrogen, carbon, boron or silicon and n represents the atomic proportion of X to $M_1$, and an inner layer of at least one metal $M_2$ bonded to the substrate, $M_1$ being zirconium and/or titanium, and $M_2$ being a metal which forms a less thermodynamically stable compound with X than does $M_1$ or forms no compound with X, said metal $M_1$ being present in an amount not less than 50% by weight of $M_1$ and $M_2$, $M_2$ being present in substantial amount not exceeding 50% of $M_1$ and $M_2$ and acting to bind the nitride, carbide, boride or silicide of $M_1$ to the metal substrate.

9. The coated metal article of claim 8 wherein the metal substrate is a ferrous alloy.

10. The coated metal article of claim 8 wherein the metal substrate is a non-ferrous alloy.

11. The coated metal article of claim 8 wherein the metal substrate is a stainless steel.

12. The coated metal article of claim 8 wherein the metal substrate is a superalloy.

13. The coated metal article of claim 8 wherein $M_1$ is zirconium.

14. The coated metal article of claim 8 wherein $M_1$ is titanium.

15. The coated metal article of any one of claims 8 to 14 in which X is nitrogen.

16. The coated metal article of any one of claims 8 to 14 in which X is carbon.

* * * * *